United States Patent [19]

Henkel et al.

[11] Patent Number: 4,988,234

[45] Date of Patent: Jan. 29, 1991

[54] GULLEY CLOSURE

[75] Inventors: Hanno Henkel, Krefeld; Karl-Heinz Rudolph, Cologne; Friedhelm Sahlmen, Moers; Rolf Brockmann, Duesseldorf, all of Fed. Rep. of Germany

[73] Assignee: Bayer Aktiengesellschaft, Leverkusen, Fed. Rep. of Germany

[21] Appl. No.: 371,781

[22] Filed: Jun. 27, 1989

[30] Foreign Application Priority Data

Jul. 20, 1988 [DE] Fed. Rep. of Germany ..... 3824485

[51] Int. Cl.[5] ..... E02D 29/14

[52] U.S. Cl. ..... 405/36; 210/163; 405/52; 404/2

[58] Field of Search ..... 405/52, 36; 210/163, 210/164; 404/2-4, 25, 26

[56] References Cited

U.S. PATENT DOCUMENTS

| | | | |
|---|---|---|---|
| 2,789,399 | 4/1957 | Finn | 405/258 X |
| 3,445,973 | 5/1969 | Stone | 210/163 X |
| 3,667,611 | 6/1972 | Pansini | 210/163 X |
| 3,763,072 | 10/1973 | Krieger | 405/270 X |
| 3,953,974 | 5/1976 | Bresson et al. | 405/270 |
| 4,102,720 | 7/1978 | Kaneko et al. | 210/164 X |
| 4,203,686 | 5/1980 | Bowman | 404/25 |
| 4,418,432 | 12/1983 | Vidal | 210/163 X |
| 4,577,996 | 3/1986 | Elias et al. | 405/270 X |
| 4,665,987 | 5/1987 | Sandiford et al. | 405/270 X |
| 4,776,722 | 10/1988 | Gaudin | 404/26 X |
| 4,787,776 | 11/1988 | Brady et al. | 405/270 |
| 4,838,732 | 6/1989 | Clark et al. | 405/52 |

*Primary Examiner*—Dennis L. Taylor

*Attorney, Agent, or Firm*—Sprung Horn Kramer & Woods

[57] ABSTRACT

The gulley closure for preventing the pollution of bodies of water in accident situations consists of a flexible mat (1) which covers the gulley surface and is coated with a highly viscous, free-flowing moulding composition (2). A plastically deformable silicone gel has proved particularly successful as a free-flowing moulding composition (2).

7 Claims, 2 Drawing Sheets

GULLEY CLOSURE

BACKGROUND OF THE INVENTION

The invention relates to a gully closure for preventing the pollution of bodies of water in accident situations.

Rain water from highways and footpaths is collected via sewer inlets also known as gullies and either drained off directly into the ground water for seepage or passed via the drainage system into a sewage-treatment plant or directly into a body of water. As a rule, the grating or gully form is not uniform. Over the course of time, different types of gully have been installed over and over again. Some gullies are provided with a stop valve; but as a rule it is difficult to reach, is normally never used and is therefore often rusted in.

In the event of accidents when dealing with hazardous liquid substances, e.g. tanker accidents, pipe fractures or leakages from containers, there is the risk of the liquids concerned flowing out and passing via the gullies into the ground water or a body of water.

Even if the gullies, in the most favourable case, are connected to a sewage-treatment plant via a drainage system, there is the risk of the biological decomposition in the sewage-treatment plant being greatly impaired or possibly coming to a complete standstill by an unforseen introduction of liquids in the event of such an accident.

SUMMARY OF THE INVENTION

The invention comes into effect at this point. The object is to develop a transportable gully closure which is simple to handle and is suitable for the most varied gully forms. This gully closure is intended, in an accident situation in which hazardous liquid substances flow out to close the gullies in the shortest time and thus avoid an uncontrolled run-off of the liquids. The liquid which has escaped can then be disposed of by conventional methods (e.g. suction or adsorption on powdery solids).

This object is achieved according to the invention by a flexible mat which covers the gully surface and is coated with a highly viscous, free-flowing moulding composition. In the event of an accident, the mat coated with the moulding composition is placed with its underside onto the gully and stamped down with the feet. Under the high pressure, the highly viscous plastic moulding composition deforms and fills all gaps and cracks in the gully. The gully is thereby sealed off from liquids. The size of the mat is selected in such a way that all common gully forms can be covered. The gully closure is thus capable of being used universally and does not depend on the specific geometry of the gully.

So-called "single-component silicone rubber compositions", which represent highly viscous, plastically deformable silicone rubber formulations which, under the effect of atmospheric moisture, vulcanize to form elastic products, have proved successful as free-flowing compositions. Since the transition from the plastic to the elastic state proceeds very slowly, good adaption to the particular gully geometry is guaranteed at the start of the application.

In the process, the sticky consistency of such moulding compositions also has a favourable effect. Chemically, they are resistant to most acids, alkaline solutions and solvents.

Formulations as described in the "Silopren-E-Informationen" issues of 1.6.1974 and 1.10.1975 from Bayer AG (AC Applications Engineering-Silicones) can be used as examples for these silicone rubber compositions but are not restricted to them.

The free-flowing moulding composition is advantageously welded air-tight in a film in order to protect it from atmospheric influences and moisture. The film is provided with a release cord so that it can be quickly removed if required.

To protect against undesired deformation of the moulding composition, in particular during transport or storage, the moulding composition can in addition be stabilized by a packing shell which, together with the air-tight film, forms a seal to the outside. This packing shell is in turn provided with a release cord which can be pulled off if required so that the packing shell can be easily removed when required, together with the film, and the moulding composition can be exposed.

The thickness of the free-flowing moulding composition is to be 10 mm to 100 mm, preferably 20 mm to 50 mm, in order to achieve a seal in all cases.

In an alternative embodiment, the gully closure consists of two silicone mats which are very different in their consistency and are firmly connected to each other by vulcanization. The upper cover plate consists of silicone rubber material which is obtained by mixing a suitable silicone polymer with fillers, pigments and crosslinking agents as well as vulcanizing catalysts. Depending on the formulation, the rubber can be converted to the elastic state on the one hand by means of suitable peroxides or via an addition reaction catalyzed by Pt-connections (W. Noll, Chemie und Technologie der Silicone, published by Weinheim).

A so-called silicone gel is now poured onto the first mat and, by heating via a Pt-catalyzed addition reaction, converted into a composition which is more plastic than elastic and is firmly joined together with the first mat.

The layer thickness of the first mat is about 1–2 cm and is made of a material having a density of $>1$ g/cm$^3$. The vulcanized-on gel composition is 2–10 cm thick and consists of a filler-free silicone material, systems containing a filler not being excluded here either.

The gully closure according to the invention offers the advantage that it can be used universally, is easy to transport (mobile) and if required can also be quickly and reliably handled by untrained personnel.

The invention is described in greater detail below with reference to exemplary embodiments and drawings, in which:

BRIEF DESCRIPTION OF THE INVENTION

DETAILED DESCRIPTION OF THE INVENTION

Figure 1:
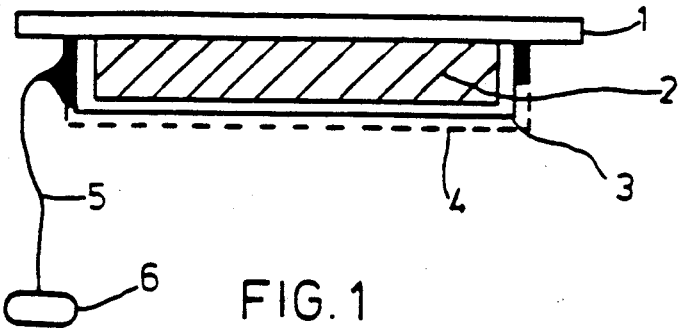
FIG. 1 shows a gully closure having a free-flowing moulding composition protected by a packing shell and film.

The gully closure according to FIG. 1 consists of a flexible, approximately 20 mm thick mat, e.g. made of silicone rubber or another flexible rubber material, which is coated on the underside with the above-described highly viscous single-component silicone rubber composition.

This composition is free-flowing in a highly viscous manner, i.e. it is deformable under pressure. The thickness of the moulding composition is about 50 mm. The moulding composition 2 is surrounded by a packing shell 3, e.g. made of Styropor, which is laminated on its outer side with an air-tight polyethylene film 4. The packing shell 3 (e.g. consisting of a cardboard box) serves as packing for the moulding composition 2 and is intended to protect it from undesired deformation, e.g. during storage or transport. The polyethylene film 4 protects the moulding composition 2 from moisture and other atmospheric influences.

A release cord 5, having a handle 6, extends transversely through the packing shell 3 and the film 4. If required, i.e. in the event of an accident in which a hazardous liquid escapes, the packing shell 3 plus the film 4 is torn open by pulling on the release cord 5 and the moulding composition 2 is exposed. The mat with the moulding composition is then placed in such a way onto the gully to be closed that the moulding composition 2 covers the entire gully surface. The mat is then stamped down uniformly. On account of the high pressure exerted in the process, the moulding composition flows into all openings and recesses of the gully grating and adheres well throughout on account of its sticky consistency, so that a sound seal is ensured (see FIGS. 3 and 4).

Figure 2:
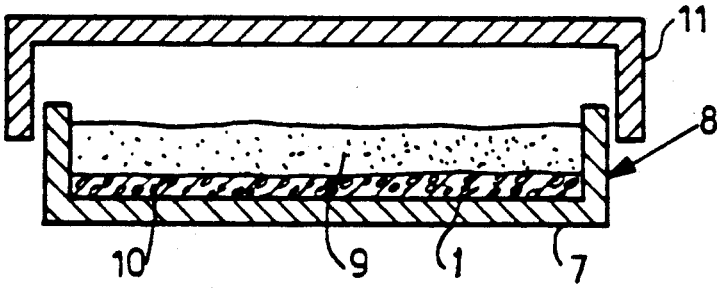
FIG. 2 shows a gully closure based on a sealing composition which, if required, is produced from a two-component mixture.

Another embodiment of the invention is shown in FIG. 2. The base 7 of an open robust carton 8 is covered with a 2 cm thick layer or mat 1 of a silicone rubber an additionally filled with a high proportion of silica sand and vulcanized at room temperature or at a higher temperature. Applied to this layer or mat 1 to a thickness of about 4 cm is a liquid silicone formulation which cures at room temperature—or even quicker at an increased temperature—to form a plastic gel layer 9.

The silicone rubber mat 1 functioning as a cover layer has a density $>1$ g/cm$^3$ and primarily serves to exert pressure on the gel layer 9 in the particular application. In an alternative embodiment, it can be replaced by an approximately 1 cm thick layer of pebbles 10 which are wetted by the penetration of the still liquid silicone formulation and are firmly joined together by subsequent vulcanization with the resulting gel. In this case, therefore, the vulcanized layer of pebbles takes the place of the mat 1 as cover layer. The carton 8 is closed by a lid 11 and can be additionally stabilized for transport by wrapping a shrink film.

If required, film and lid 11 are removed, the lower carton 8, which contains the gel layer 9, is torn open at the corners and the side walls of the carton 8 are removed so that the exposed gel layer 9 can be pressed onto the gully to be closed, the cover layer or mat 1 lying at the top and forming the outer seal.

Figure 3:
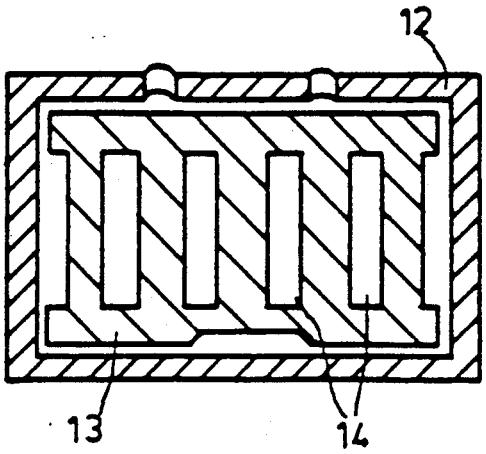
FIGS. 3 and 4 show plan views of various gully forms.
Figure 4:
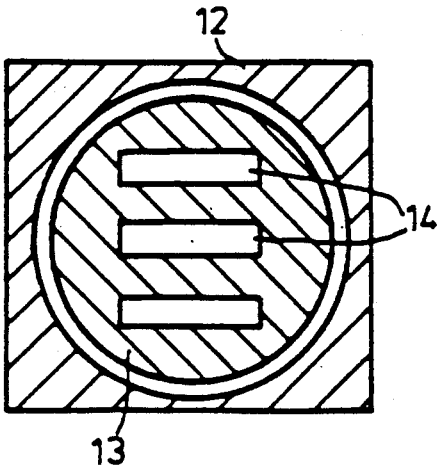

As an illustration, examples of various gully forms are sketched in FIGS. 3 and 4. The gullies shown here consist of the frame 12 and the gully grating 13 having openings 14. By the gully closure according to the invention, the openings 14, and what is more the gaps between the frame 12 and the grating 13, are reliably closed.

Figure 5:
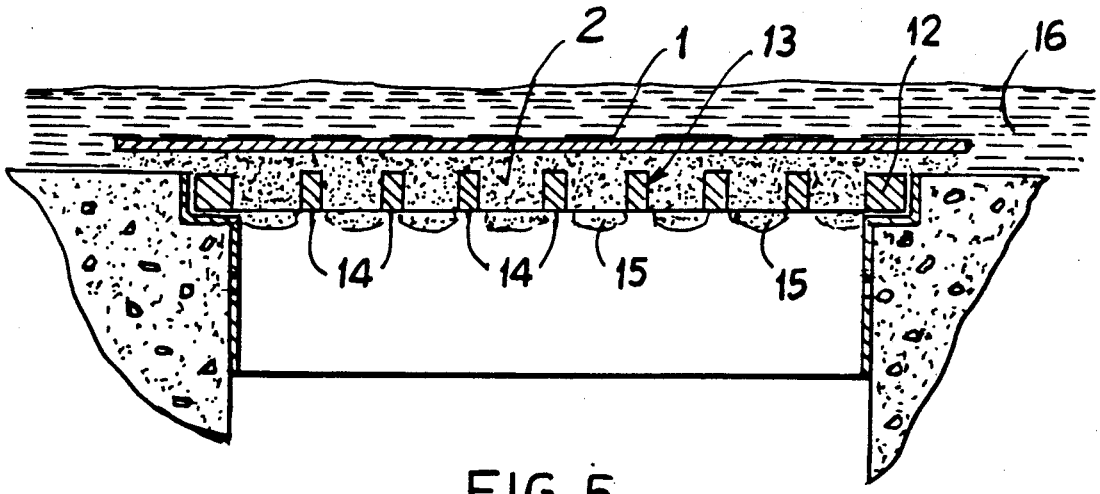
FIG. 5 shows a closure according to the invention on a grating.

FIG. 5 shows mat 1 on grating 13 in frame 12. The protruding lumps of viscous composition fill the interstices between rungs 14 and stop liquid 16 from running into the drain.

Various examples of application for the novel gully closure are described below.

Application a

During the transport of a container on a works road, the bottom discharge valve breaks off so that the liquid product flows out. By the gully closure, the liquid, which is harmful to water, can be prevented from flowing into the gully and the liquid which has flown out can then be specifically disposed of.

Application b

In an industrial concern, a liquid which is harmful to water escapes from a pipeline bridge as a result of corrosion. By immediate closure of the road gullies by means of the gully closure mats, it was possible to prevent pollution of bodies of water and controlled removal could be carried out.

Application c

A tanker loaded with petrochemical raw material is in a road collision. By closing the surrounding road gullies, the product flowing out can be collected and specifically disposed of.

Application d

During a fire fighting operation, by closing the nearest gully openings, the water for fire fighting is confined and specifically disposed of.

An abundance of possible examples of application makes the introduction of the universally useable novel closure appear logical and necessary. Carrying and keeping ready a number of gully closures when transporting liquids harmful to water and also placing the same in the proximity of gullies at frequented filling and reloading points is highly desirable to minimize pollution of water and bodies of water.

We claim:

1. A closure for inlet grating of a fluid drainage system comprising: a flexible substrate for covering an exposed surface of an inlet grating having drainage holes therein and a viscous, free flowing composition on one side of the substrate facing the exposed surface of the inlet grating for directly contacting the inlet grating and at least partly filling the drainage holes to liquid tightly seal same.

2. The closure according to claim 1, wherein the composition comprises a plastically deformable silicon gel.

3. The closure according to claim 1, further comprising a removable air-tight covering enclosing the composition for removal prior to use.

4. The closure according to claim 1, further comprising a removable shell enclosing the composition with the substrate and a removable film for air-tightly sealing the shell and composition.

5. The closure according to claim 1, wherein the composition is 10 to 100 mm thick.

6. The closure according to claim 1, wherein the composition is 20 to 50 mm thick.

7. The closure according to claim 1, wherein the substrate comprises a pebble layer vulcanized into the composition.

* * * * *